US006711787B2

(12) United States Patent
Jungkind et al.

(10) Patent No.: US 6,711,787 B2
(45) Date of Patent: Mar. 30, 2004

(54) TURN-LOCK FASTENER, ESPECIALLY FOR SHOES

(75) Inventors: Roland Jungkind, Garmisch-Partenkirchen (DE); Theodor Hofmann, Schlusselfeld (DE)

(73) Assignee: Puma Aktiengesellschaft Rudolf Dassler Sport, Herzogenaurach (DE)

( * ) Notice: Subject to any disclaimer, the term of this patent is extended or adjusted under 35 U.S.C. 154(b) by 0 days.

(21) Appl. No.: 10/220,421

(22) PCT Filed: Feb. 26, 2001

(86) PCT No.: PCT/DE01/00715

§ 371 (c)(1),
(2), (4) Date: Sep. 3, 2002

(87) PCT Pub. No.: WO01/64069

PCT Pub. Date: Sep. 7, 2001

(65) Prior Publication Data

US 2003/0020288 A1 Jan. 30, 2003

(30) Foreign Application Priority Data

Mar. 2, 2000 (DE) ..... 200 03 854

(51) Int. Cl.[7] ..... A43C 11/16; A43B 5/04; A44B 21/00

(52) U.S. Cl. ..... 24/68 SK; 24/69 SK; 24/70 SK; 24/71 SK; 36/50.1; 36/117

(58) Field of Search ..... 24/68 SK, 69 SK, 24/70 SK, 71 SK, 71.1 SK, 713, 712.1; 36/50.1, 50.5, 54, 117

(56) References Cited

U.S. PATENT DOCUMENTS

| | | | | | |
|---|---|---|---|---|---|
| 4,719,710 | A | * | 1/1988 | Pozzobon | 36/117.7 |
| 4,761,859 | A | | 8/1988 | Calabrigo | |
| 4,951,402 | A | * | 8/1990 | Benoit et al. | 36/50.5 |
| 5,177,882 | A | | 1/1993 | Berger | |
| 5,600,874 | A | * | 2/1997 | Jungkind | 24/68 SK |
| 5,606,778 | A | | 3/1997 | Jungkind | |
| 5,638,588 | A | * | 6/1997 | Jungkind | 24/68 SK |
| 5,745,959 | A | * | 5/1998 | Dodge | 24/68 SK |

FOREIGN PATENT DOCUMENTS

| | | |
|---|---|---|
| DE | 42 40 916 C | 10/1993 |
| DE | G 93 12 197.0 U1 | 2/1995 |
| EP | 0 351 653 A | 1/1990 |
| WO | WO 98 33408 A | 8/1998 |

* cited by examiner

*Primary Examiner*—Victor Sakran
(74) *Attorney, Agent, or Firm*—Nixon Peabody LLP; David S. Safran

(57) ABSTRACT

The invention relates to a turn-lock fastener (2) for detachably adjusting and varying the effective length of at least one tensioning element (6) with a winding device which can be Actuated at least in a closing direction via a turning grip (13) that can be actuated around a central axis (2.1). The inventive turn-lock fastener should be designed in such a way that it can be easily inserted into a base plate (1) and can be easily removed therefrom. To this end, the turn-lock fastener (2) and the base plate (1) are interconnected in an articulated manner via a turning joint (1.3, 1.4) in such a way that the turn-lock fastener (2) can be pivotally folded down like a flap to the base plate (1) and can thereby locked with the same or the turn-lock fastener can be foleded away from the base plate and can thereby be unlocked from the same.

14 Claims, 2 Drawing Sheets

FIG.1
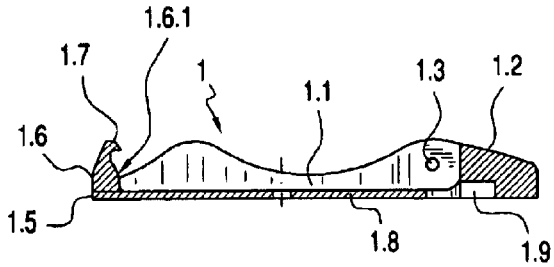
FIG.2
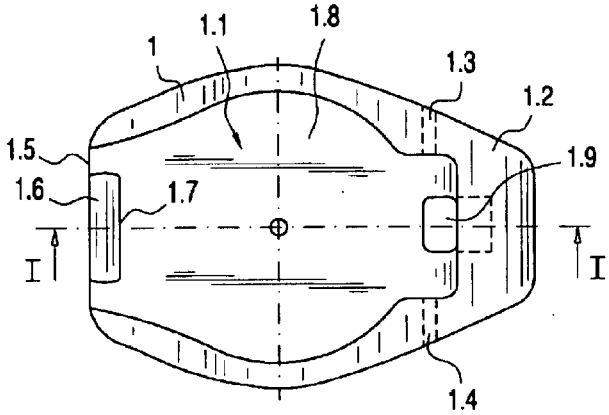
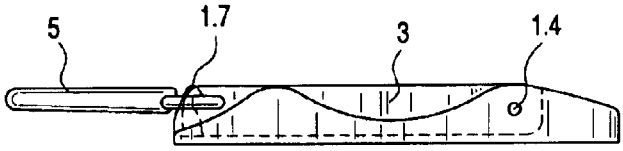
FIG.3
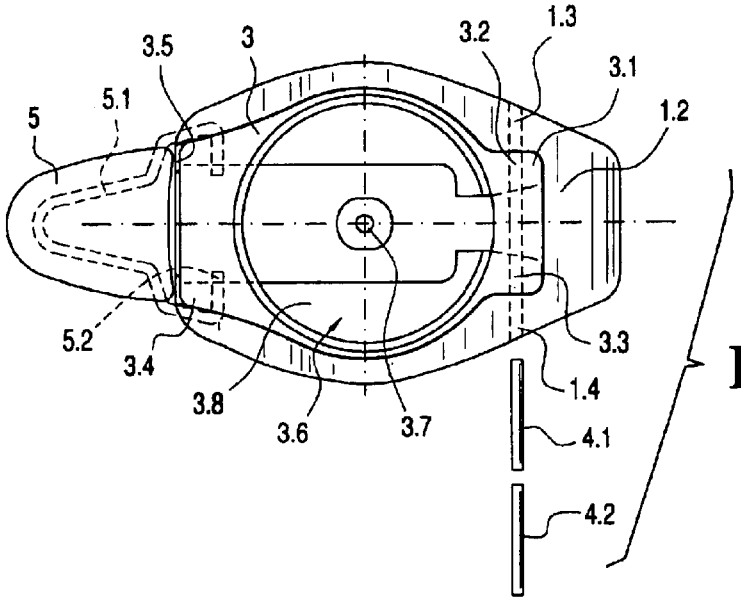
FIG.4

FIG.5
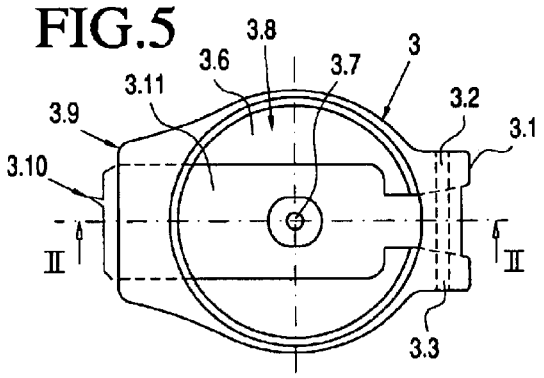
FIG.10
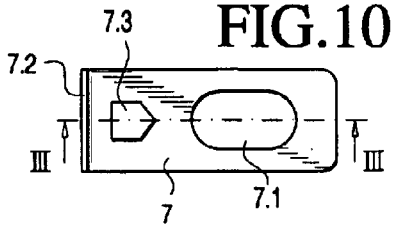
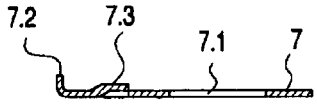
FIG.11
FIG.6
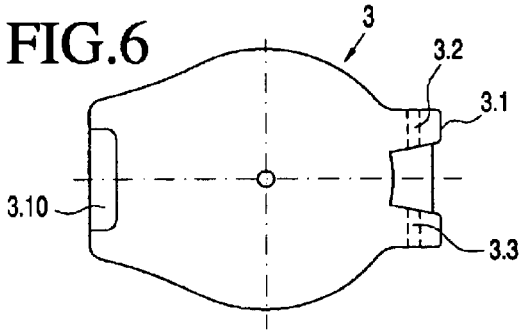
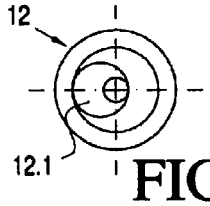
FIG.12
FIG.7
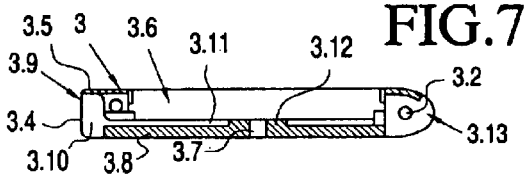
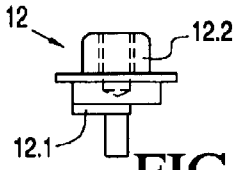
FIG.13
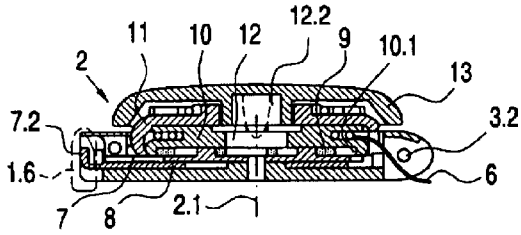
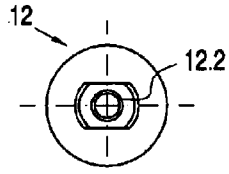
FIG.14
FIG.8
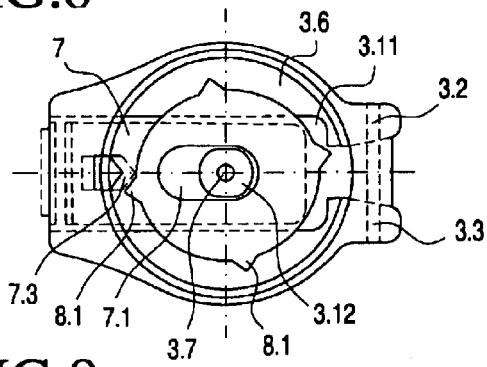
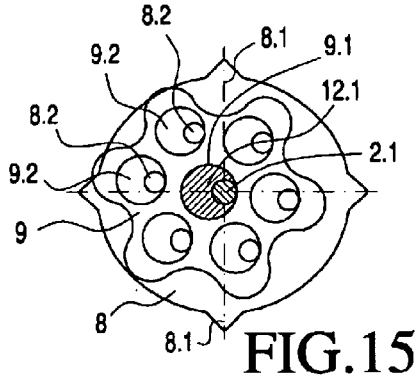
FIG.15
FIG.9

TURN-LOCK FASTENER, ESPECIALLY FOR SHOES

This invention relates to a turn-lock fastener, especially for shoes, as claimed in the preamble of claim 1.

One such turn-lock fastener is known from German utility model DE 93 12 197 U1.

There, it is a turn-lock fastener with a cam gear. On the housing part which accommodates the cam gear on the periphery a catch element is pivotally supported; it is pretensioned by a spring in the catch direction and is made as a lever. This catch element fits with a catch member with pretensioning into one of a plurality of recesses at a time on the outside edge of a ratchet wheel which cannot turn in the operating position and locks it in its operating or drive position. Via a tension belt which can be actuated from the outside the other lever arm can be swivelled against the spring action and the catch element can be pulled out of the respective recess. In this way the ratchet wheel can turn freely and thus the turn-lock fastener can be opened very quickly without needing to be turned on the handle of the turn-lock fastener. Here the turn-lock fastener is inserted into a housing part and is locked essentially captively to it.

The cam gear, to the manner of operation of which reference is made expressly here, is described in German patent DE 42 40 916 C1.

Making a turn-lock fastener with a gear in the manner of a planetary gear is also known. Here the construction can also be such that a stationary disk is locked in the operating position and by fast unlocking of the fastener via a fast release means is made to be able to turn freely.

The object of this invention to devise a turn-lock fastener of the initially mentioned type such that it can be easily inserted into a base plate and also can be easily removed from it again. But mainly it is to become possible to quickly unlock the turn-lock fastener in a simple manner.

This object is achieved by the features of claim 1.

As claimed in the invention, when the turn-lock fastener is folded-in, a quick release means, for example a slide, is blocked in the position in which it holds a member of the drive between a twist grip and a winding device in the position fixed in the operating position. When folded away the quick release means conversely can be moved such that the locking of the fixed member is cancelled and the winding device is decoupled from its drive. This eliminates the spring which is necessary in the initially mentioned turn-lock fastener with quick relief of the tensioning element for the quick release member and the tension belt which is necessary for this purpose. Moreover, the turn-lock fastener, even when unintentionally lifted out of its base plate, remains connected to it such that simple and reliable re-insertion is possible by a simple swivelling motion.

Other advantageous details of the invention are given in the dependent claims and are detailed below using the embodiments illustrated in the drawings.

FIG. 1 shows the base plate of a turn-lock fastener as claimed in the invention seen from the side according to section I—I of FIG. 2, FIG. 2 shows an overhead view of the base plate as shown in FIG. 1, FIG. 3 shows a side view of the base plate with the housing part of the turn-lock fastener inserted with a gripping clip, FIG. 4 shows an overhead view of the base plate with the housing part from FIG. 3 inserted;

FIG. 5 shows an overhead view of the housing part of the turn-lock fastener;

FIG. 6 shows a side view of the bottom of the housing part of FIG. 5;

FIG. 7 shows a side view of the housing part according to section II—II of FIG. 5, FIG. 8 shows a side view in a section as shown in FIG. 7, but with rotary gearing inserted with a twist grip, FIG. 9 shows an overhead view of the housing part with a quick release means made as a slide and a lockable disk of the rotary gearing made as a cam gear, FIG. 10 shows an overhead view of the slide, FIG. 11 shows a side view of the slide according to section III—III of FIG. 10;

FIG. 12 shows a bottom view of a cam drive journal,

FIG. 13 shows a side view of the cam drive journal of FIG. 12,

FIG. 14 shows an overhead view of the cam drive journal of FIG. 12, and

FIG. 15 shows an overhead view of the lockable disk with the cam drive disk of a cam gear resting on it.

FIGS. 1 to 3 show a base plate 1 of a turn-lock fastener 2, especially for opening and closing shoes. The base plate 1 has a recess 1.1 for the housing part 3 of the turn-lock fastener 2. The housing part 3 is shown by way of example in FIGS. 7 and 8 in a section each.

The housing part 3 can be inserted into the base plate 1 together with the other parts of the turn-lock fastener 2 by folding-in. To do this the base plate 1 on the end area 1.2 which is the right one in the drawings has one bearing hole 1.3 and 1.4 each laterally.

The end 3.1 of the housing part 3, i.e. the end which is the right one in the drawings and which is made like a clip, has bearing holes 3.2 and 3.3 which correspond to them. In this way, by inserting axles 4.1 and 4.2, screws or the like, a hinge is formed via which the turn-lock fastener 2 or its housing 3 is articulated to the base plate 1. The turn-lock fastener 2 can thus be folded in the manner of a flap onto or into the base plate 1, folded away from it, or folded out of it. The recess 1.1 of the base plate 1 and the contour of the housing part 3 are matched to one another.

On the end 1.5 of the base plate 1, i.e. the end which is opposite the right end area 1.2 of the base plate 1, there is a catch clip 1.6 with a catch projection 1.7 which interacts with a suitable catch means of the housing part 3, for example the top edge 3.5 which is present in the drawings on the left end 3.4 (FIG. 4). In this way the housing part 3 and thus the turn-lock fastener 2 are detachably locked to the base plate 1 in the swivelled-in or folded-in state.

By pulling on the gripping clip 5 attached to the housing part 3 the locking force can be overcome and the housing part 3 together with the other parts of the turn-lock fastener 2 can be swivelled out or folded out. The handle clip 5 can be attached to the housing part 3 via a hinge. For example, this can be the illustrated claw 5.1 which is molded into the handle clip 5 and which is suspended with its hooks 5.2 in the housing part 3.

In the right end area 1.2 and in the bottom 1.8 there is an opening 1.9 for passage of the tension element 6 of the turn-lock fastener 2.

The structure of the turn-lock fastener 2 as claimed in the invention and the arrangement and action of the quick release means are detailed in FIGS. 5 to 9. The individual parts used here are shown additionally for better understanding using the detailed drawings shown in FIGS. 10 to 15.

The housing part 3 has a round or elliptical recess 3.6 with a central hole 3.7 in its bottom 3.8. On the left end 2.4 in the wall 3.9 is a horizontal lengthwise slot 3.10 which passes from the outside to the inside. From the outside a quick release means which is made in this case as a flat slide 7 and which is used for locking and unlocking can be pushed to the inside through this lengthwise slot 3.10. To guide and hold the slide 7 the bottom 3.8 has a recess 3.11 with a depth corresponding to the thickness of the slide 7 and with a length and width somewhat greater than the corresponding dimensions of the slide 7. In the slide 7 is a lengthwise recess, here in the form of a lengthwise hole 7.1. An elevation on the bottom 3.8 of the housing part 3 fits into this elongated hole 7.1. In this case this is a shoulder 3.12 which coaxially surrounds the hole 3.7. Its diameter or its width is somewhat smaller than the width of the lengthwise hole 7.1. In this way the sliding direction of the slide 7 is fixed and the movement capacity of the slide 7 in the lengthwise direction is limited by the length of the elongated hole 7.1 after its insertion. On the right end 3.1 the housing part 3 is opened to the outside by a recess 3.13 for the passage of the tension element 6.

Preferably the slide 7, as shown in FIGS. 10 and 11, on its end projecting to the outside has a bent-up edge 7.2. Furthermore, a locking tooth 7.3 which is pressed out upward, which projects into the space of the recess 3.6 and interacts there with a tooth 8.1 or with the groove of a lockable disk 8 of a gear, especially a step-down gear, is mounted on the slide 7 for tensioning and releasing the tension element 6. The lockable disk 8 rests on the bottom 3.8 and optionally also on the slide 7. It corresponds for example to the coupling disk of the cam drive which is indicated as known from DE 42 40 916 C1 at the start. As such, as shown in FIG. 15 it has a number of coupling pins 8.2 which are attached concentrically to the central axis 2.1 of the turn-lock fastener 2 and angularly-symmetrically to one another. In the embodiment there are six coupling pins 8.2 which are each located angularly offset by 60° to one another.

On the disk 8 there is a cam gear disk 9 with a central circular cutout 9.1, and with circular cutouts 9.2 which are present in the same number, which have the same size, which correspond to the coupling pins 8.1 of the disk 8 and which are mounted concentrically to the central cutout. The outside contour of the cam gear disk 9 has a tooth profile. On the cam gear disk 9 is a winding device for the tension element 6, made as a pulley 10. The inside edge 10.1 of the pulley 10 has a tooth contour which interacts with the teeth of the cam gear disk 9. There is a cover disk 11 over the pulley 10. All disks are centered by the cam drive journal 12. The cam gear disk 9 is supported to be able to move eccentrically by the cam drive disk 12.1 of the cam drive journal 12. On the top end 12.2 of the cam drive journal 12 there is a twist grip 13.

The invention works as follows:

The turn-lock fastener 2 is in the operating position shown in FIGS. 8 and 9. The turn-lock fastener 2 is therefore located in the folded-in position. The catch clip 1.6 of the base plate 1 has pushed the slide 7 into the locked position, i.e. the slide 7 is pushed to the right in the drawings. In doing so its locking tooth 7.3 projects into the groove area between adjacent teeth 8.1 of the lockable disk 8 so that it cannot be turned or, as in the embodiment here, can be turned only by a small angular range, from roughly 70° to 80°. In this position the housing part 3 or the turn-lock fastener 2 is locked on the base plate 1 and the twist grip 13 can be turned in the tensioning direction or release direction. The shoe or other article of clothing can be closed or opened therefore via the twist grip 13. Since this takes placed via step-down gearing, opening requires a certain time interval.

If the shoe, a piece of clothing or an accessory thereto is to be quickly opened, by pulling on the gripping clip 5 the turn-lock fastener 2 is folded out of the recess 1.1 of the base plate 1. In this way the catch clip 1.6 releases the slide 7. In this way the locking tooth 7.3 can be pushed out of the area of the teeth 8.1 of the lockable disk 8. This takes place for example with the tension which occurs on the tension element 6 because in this way the pulley 10 and with it the cam gear disk 8 are turned in the release direction. In doing so a tooth 8.1 strikes the tooth profile of the engaging locking pin 7.3. In this way the locking tooth 7.3 is pressed out of the path of motion of the teeth 8.1. In this way the slide 7 is pushed to the outside in the released position. Therefore it can no longer prevent the rotary motion of the cam gear disk 6.

When the turn-lock fastener 2 is folded into the recess 1.1 of the base plate 1, the slide 7 is pushed to the inside by the catch clip 1.6 via its leading surface 1.6.1 which engages the edge 7.2 of the slide 7. If it does not travel into the groove or groove area between two teeth 8.1, but onto a tooth 8.1, it will continue to move tooth 8.1 in the direction of rotation of the disk 8 when the locking tooth 8.1 strikes the profile of the tooth 8.1 opposite at this instant so that the slide 7 moves into its locking position. Thus, the cam gear disk 8 can no longer be turned and the gear of the turn-lock fastener 2 is in the operating position.

The invention can also be used in rotary drives with other gearing. For example, use in conventional planetary gears is possible, in which likewise there are disks or gearing parts which are locked in a rotary position in order to shift the turn-lock fastener into operating readiness or keep it in the latter.

Instead of the locking tooth 7.3 which is present on the slide 7 or on the other quick release means there can also be a locking groove, then there necessarily being a corresponding tooth 8.1 on the lockable disk 8.

Instead of the illustrated single tension element 6, two or more tension elements can be used.

Aside from the described locking, the turn-lock fastener 2 can also be kept in the tensioned position by self-locking, as is conventional.

Even if this invention is intended preferably for shoes, especially athletic and recreational shoes, this invention can also be used with the same or similar advantages in other useful articles as well. Other applications include especially outside clothing, such as pants, skirts, jackets or also gloves, especially sports gloves.

This invention can also be used to advantage in accessories for articles of outside clothing, such as for example belts or head coverings, such as for example caps or protective helmets of all types.

What is claimed is:

1. Turn-lock fastener for releasable adjustment and changing of the effective length of at least one elongated tensioning element, comprising:

a winding device having housing part and a winding element on which the elongated tensioning element is windable, a twist grip for rotation of the winding element around a central axis thereof at least in a closing direction for winding of the tension element on the winding, and a base plate on which the winding device is fixable by a catch with the winding element locked in a tensioned position, wherein the winding device and the base plate are hinged to one another via a hinge such that the winding device is pivotable in the manner of a flap toward the base plate, and in doing so, locked to it by the catch, and away from the base plate, and thus, released from the base plate, and wherein at least one quick release means is provided for canceling locking of the winding device, the quick release means, in a pivoted-in state of the winding device, being blocked in a locking position, and being movable in a release direction in a pivoted-away state of the winding device.

2. Turn-lock fastener as claimed in claim 1, wherein the hinge comprises a pivot joint provided in an edge area of the winding device.

3. Turn-lock fastener as claimed in claim 1, wherein a step-down gearing is provided between the twist grip and the winding element.

4. Turn-lock fastener as claimed in claim 3, wherein the step-down gearing comprises a rotary disk with at least one tooth or groove with which the disk is lockable, and wherein the quick release means has at least one locking groove or tooth that is engageable with the respective at least locking groove or tooth of the disk in a locked state thereof.

5. Turn-lock fastener as claimed in claim 3, wherein the step-down gearing comprises a cam gear.

6. Turn-lock fastener as claimed in claim 3, wherein the step-down gearing comprises a planetary gear.

7. Turn-lock fastener as claimed in claim 1, wherein the catch comprises catch elements on the winding device and the base plate at a location thereof that is at an opposite end of the winding device and the base plate from said hinge.

8. Turn-lock fastener as claimed in claim 1, wherein a gripping clip is provided on an end of the housing part of the winding device that is opposite an end thereof at which the hinge is located.

9. Turn-lock fastener as claimed in claim 8, wherein the gripping clip is pivotably connected to the housing of the winding device.

10. Turn-lock fastener as claimed in claim 1, wherein the winding element is a lockable disk, and wherein the quick release means comprises a slide which is movable between the lockable disk and the housing part of the winding device.

11. Turn-lock fastener as claimed in claim 10, wherein the slide has a lengthwise recess which runs in a sliding direction, wherein a shoulder which surrounds the central axis is received in said recess, wherein one end of the slide projects to the outside through an opening of the housing part, wherein the slide and the lockable disk each have at least one of a groove or elevation which are associated with each other and which run radially for guiding the slide in the sliding direction.

12. Turn-lock fastener as claimed in claim 10, wherein the slide in the pivoted-in state is locked in a pushed-in position.

13. Turn-lock fastener as claimed in claim 12, wherein the base plate has a leading surface on which an outer edge of the pushed-out slide makes contact when the winding device is pivoted-in and which can be pushed inward for locking of the lockable disk.

14. Turn-lock fastener as claimed in claim 11, wherein the end of the slide which end projects through the opening is bent in a direction toward the twist grip.

* * * * *